US005701565A

United States Patent [19]

Morgan

[11] Patent Number: 5,701,565

[45] Date of Patent: Dec. 23, 1997

[54] WEB FEED PRINTER DRIVE SYSTEM

[75] Inventor: Paul F. Morgan, Rochester, N.Y.

[73] Assignee: Xerox Corporation, Stamford, Conn.

[21] Appl. No.: 624,280

[22] Filed: Mar. 29, 1996

[51] Int. Cl.[6] ..... G03G 15/01

[52] U.S. Cl. ..... 399/299; 399/167; 399/384

[58] Field of Search ..... 355/326 R, 327; 399/384, 40, 167, 299, 300, 306

[56] References Cited

U.S. PATENT DOCUMENTS

| | | | |
|---|---|---|---|
| 5,153,644 | 10/1992 | Yang et al. | 355/236 |
| 5,160,946 | 11/1992 | Hwang | 355/327 |
| 5,274,428 | 12/1993 | Wong et al. | 355/326 R |
| 5,313,252 | 5/1994 | Castelli et al. | 355/203 |
| 5,455,668 | 10/1995 | DeBock et al. | 355/326 R |
| 5,461,470 | 10/1995 | De Cock et al. | 355/326 R |
| 5,481,339 | 1/1996 | De Cock et al. | 355/245 X |
| 5,499,093 | 3/1996 | Aerens et al. | 355/326 R |
| 5,506,671 | 4/1996 | Buts et al. | 355/326 R |
| 5,526,108 | 6/1996 | Billet et al. | 355/326 R |
| 5,539,498 | 7/1996 | De Cock et al. | 355/200 |

FOREIGN PATENT DOCUMENTS

| | | |
|---|---|---|
| 4-324882 | 11/1992 | Japan . |
| 4-324883 | 11/1992 | Japan . |

*Primary Examiner*—Matthew S. Smith
*Attorney, Agent, or Firm*—Kevin R. Kepner

[57] ABSTRACT

Each photoreceptor unit in a multi station printing system has a torque limited drive unit which provides rotational torque to overcome most of, but not all, of the rotational drag forces on the photoreceptors. In this manner, the web contact with the photoreceptor can control the speed of the photoreceptor by overrunning the torque provided by the motor but minimizing the possibly of slip or tearing of the web due to high torque loads imparted to the web by the multiple photoreceptor units of the printer.

9 Claims, 3 Drawing Sheets

WEB FEED PRINTER DRIVE SYSTEM

Disclosed is an improved drive system for a web feed printing machine. More particularly, there is disclosed a partial torque assisted photoreceptor drive to prevent slip between a web image receiving member and one or more photoreceptive imaging members and/or tearing of the web, due to high torque loads, without requiring complex, expensive and critical servomotor feedback controlled systems such as in examples cited below.

In a typical electrophotographic printing process, a rotated photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted to the latent image forming a toner powder image on the photoconductive member. The toner powder image is then transferred from the photoconductive member to a copy receiving sheet or an endless web as described herein. The toner particles are heated to permanently affix the powder image to the web. The web is then subsequently cut into individual sheets for post printing finishing. After each transfer process, the toner remaining on the photoconductor is cleaned by a cleaning device.

These processes and other frictional resistances impose torque drag on the photoreceptive member, resisting its rotation. Thus, the photoconductive member is usually driven by its own motor, especially in a color printer, where several photoconductive members in series must transfer the images formed thereon superposed in registration with one another onto the same image receiving web. Monitoring and controlling such registration accurately is difficult. The below cited U.S. Pat. No 5,455,668 attempts to avoid such superposed image registration problems by driving the photoconductive members rotations solely by the drive movement of the web, by the limited transfer station adhesion of the web thereto. However, this inventor has noted that this can still impose said above-noted undesirable photoconductive drag torques on the web. That can tear the web, and/or cause misregistration by slip occurring between the web and one or more of the photoconductive members.

The following disclosures are noted as to various aspects of the present invention:

U.S. Pat. No. 5,455,668

Patentee: DeBock et al.

Issue Date: Oct. 3, 1995

U.S. Pat. No. 5,313,252

Patentee: Castelli, et al.

Issue Date: May 17, 1994

U.S. Pat. No. 5,160,946

Patentee: Hwang

Issue Date: Nov. 3, 1992

U.S. Pat. No. 5,153,644

Patentee: Yang, et al.

Issue Date: Oct. 6, 1992

Some portions of the foregoing disclosures may be briefly summarized as follows:

U.S. Pat. No. 5,455,668 describes a single pass multi color multi station electrostatographic printing machine in which the plural image forming stations are driven by a web of paper.

U.S. Pat. No. 5,313,252 describes an apparatus and method for correcting image smear by creating a pattern of registration marks and varying the velocity of a photoreceptor and an image receiving surface to determine the best speed match between the two driven surfaces.

U.S. Pat. No. 5,160,946 describes a registration system for an electrophotographic printing machine which forms registration indicia at a first transfer station and utilizes the formed indicia to register the image at subsequent transfer stations.

U.S. Pat. No. 5,153,644 describes a device for dual mode correction of image distortion due to motion errors between a photoreceptor and an image receiving member in an electrophotographic printing machine. Low frequency errors are corrected by a servo motor which variably drives the photoreceptor and compensates for the low frequency errors, and high frequency errors are corrected by varying the imaging optical system.

The features of the disclosed embodiment include in a reproduction system in which flimsy paper or other such print substrate is fed as a continuous and moving web past a rotating imaging system surface, from which surface print images are transferred to said web print substrate while a minor portion of said web is in contact with a portion of said surface of said rotating imaging system, and wherein said rotating imaging system is designed to be rotated by said engagement and movement of said moving image substrate web by said web, by said web being pulled by a web pulling force at a substantially constant velocity from downstream of said rotating imaging system, so as to attempt to provide continuous non-slip synchronous movement of said print substrate web and said imaging system surface while they are in said contact, and wherein said rotating imaging system has a resistance to said rotation by said web, the improvement comprising applying an independent rotational force to said rotating imaging system which is not substantially more than, said resistance to rotation of said rotating imaging system, so as not be able to rotate said rotating imaging system faster than said web velocity, yet which independent rotational force is sufficient to substantially reduce said downstream web pulling force on said web needed to rotate said rotating imaging system.

Other disclosed features, independently or in combination, include a plurality of said rotating imaging systems sequentially rotated by the same said moving web print substrate, and said independent rotational force is independently applied to each said rotating imaging system, in particular, by a torque limited electric motor.

Other features of the present invention will become apparent as the following description proceeds and upon reference to the drawings, in which.

Referring to the Figures, while the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
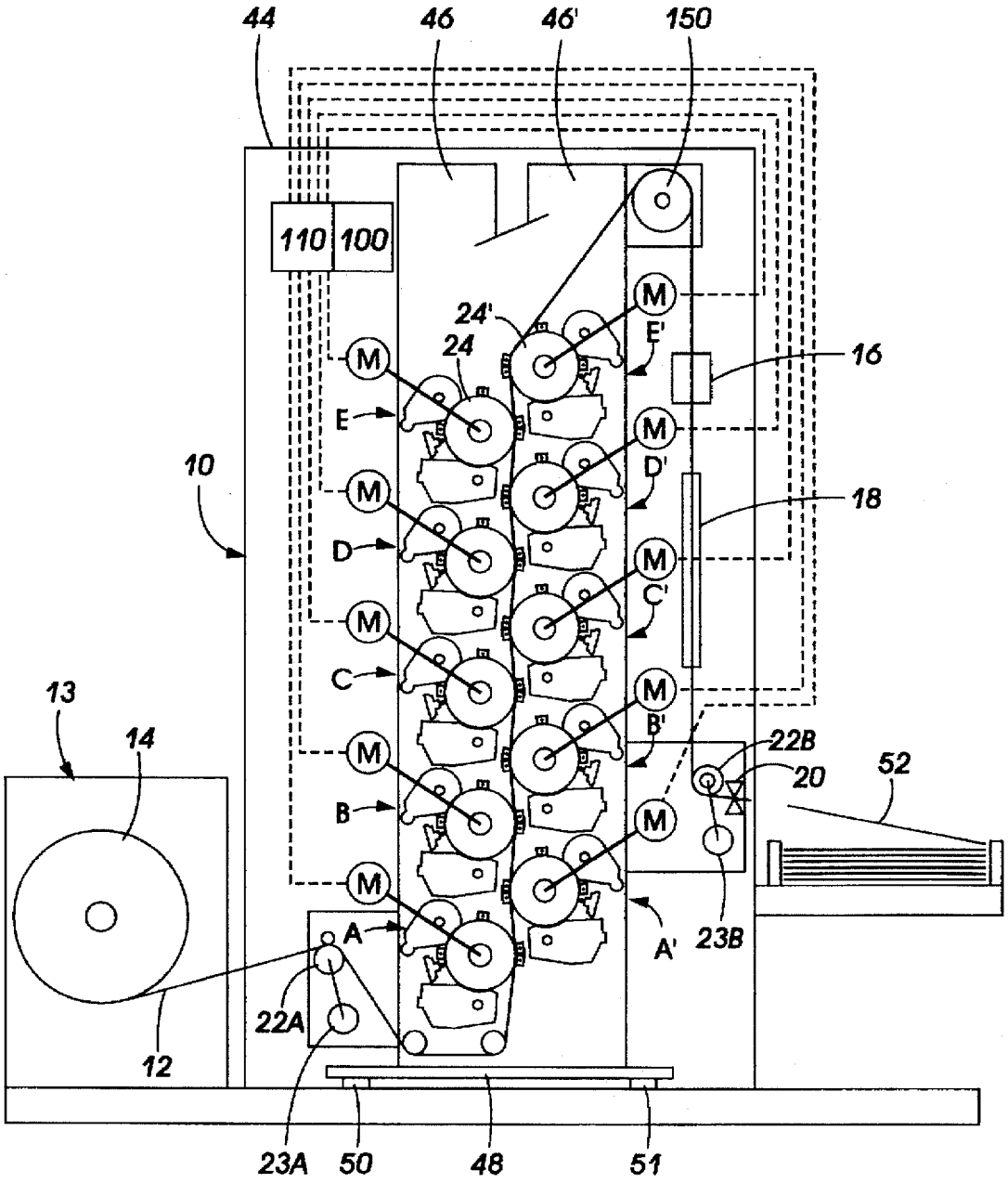
FIG. 1 shows schematically an elevational view of one example of an electrostatographic single-pass multiple station color printer utilizing the invention, for improved web duplex printing.

The printer 10 example in FIG. 1, as further described in said U.S. Pat. No. 5,455,668, comprises 8 printing stations A, A', B, B', C, C' and D, D' which are arranged to print yellow, magenta, cyan and black images respectively. The printing stations (i.e., image-producing stations) are arranged in a substantially vertical configuration, although it is of course possible to arrange the stations in a horizontal or other configuration. A web of paper 12 unwound from a supply roller 14 is conveyed in an upwards direction past the printing stations in turn. The moving web 12 is in face-to-face contact with the drum surface 26 over a wrapping angle omega (ω) of about 15 degrees (see FIG. 2) determined by the position of opposed drum 26'. After passing the last printing station D, the web of paper 12 passes through an image-fixing station 16, an optional cooling zone 18 and thence to a cutting station having cutter 20 to cut the web 12 into sheets. The web 12 is conveyed through the printer by a motor-driven drive rollers 22A, 22B. Tension in the web may be generated by the application of a brake (not shown) acting upon the supply roller 14, or by a pair of motors as described below.

Further referring to FIG. 1, duplex printer 10 has a supply station including roll stand 13 in which the roll 14 of web material 12 is housed, in sufficient quantity to print, say, up to 5,000 images. The web 12 is conveyed into a tower-like printer housing 44 in which two columns 46 and 46' are provided each housing four similar printing stations A to E and A' to E' respectively. In addition, further stations E and E' may be provided in order to optionally print an additional color, for example a specially customized color, for example white. The columns 46 and 46' are mounted closely together so that the web 12 travels in a generally vertical but slightly convoluted path defined by the facing surfaces of the imaging station drums 24, 24'. This arrangement is such that each imaging station drum acts as the guide roller for each adjacent drum by defining the wrapping angle (ω). The columns 46, 46' may be mounted against vibrations by means of a platform 48 resting on springs 50, 51. Although in FIG. 1 the columns 46 and 46' are shown as being mounted on a common platform 48, it is possible in an alternative embodiment for the columns 46 and 46' to be separately mounted, such as for example being mounted on horizontally disposed rails so that the columns may be moved away from each other for servicing purposes and also so that the working distance between the columns may be adjusted.

After leaving the final printing station E, the image on the web is fixed by means of the image-fixing station 16 and fed to a cutting station 20 (schematically represented) and a stacker 52 if desired. The web 12 is conveyed through the printer by two drive rollers 22A, 22B one positioned between the supply station 13 and the first printing station A and the second positioned between the image-fixing station 16 and the cutting station 20. The drive rollers 22A, 22B are driven by controllable motors, 23A, 23B. One of the motors 23A, 23B is speed controlled at such a rotational speed as to convey the web through the printer at the required speed, which may for example be about 125 mm/sec. The other motor is torque controlled in such a way as to generate a web tension of, for example, about 1 N/cm web width.

Figure 2:
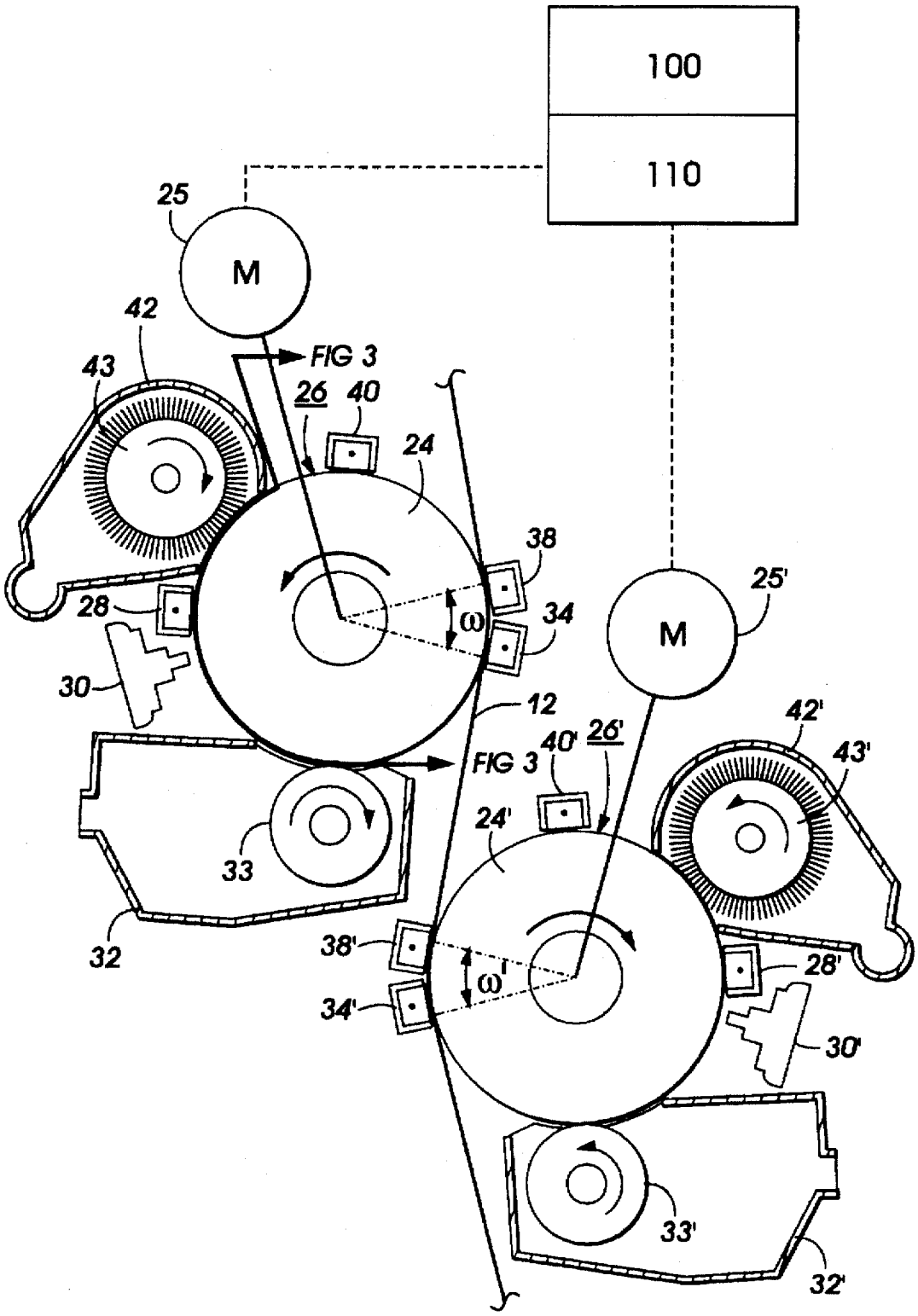
FIG. 2 shows in detail a partial cross-section of one pair of the duplex print stations of the printer shown in FIG. 1 incorporating one example of the torque relief partial drive of the photoreceptive member.

As shown in FIG. 2, each opposed printing station comprises a cylindrical drum 24 having a photoconductive outer surface 26. Circumferentially arranged around the drum 24 (also referred to as PR where PR stands for photoreceptor) there is a main corotron or scorotron charging device 28 capable of uniformly charging the drum surface 26, for example to a potential of about −600V, an exposure station 30 which may, for example, be in the form of as scanning laser beam or an LED array, which will image-wise and line-wise expose the photoconductive drum surface 26 causing the charge on the latter to be selectively reduced, for example to a potential of about −250V, leaving an image-wise distribution of electric charge to remain on the drum surface 26. This so-called "latent image" is rendered visible by a developing station 32 which by means known in the art will bring a developer in contact with the drum surface 26. The developing station 32 includes a developer drum 33 which is adjustably mounted, enabling it to be moved radially towards or away from the drum 24 for reasons as will be explained further below. According to one embodiment, the developer contains (i) toner particles containing a mixture of a resin, a dye or pigment of the appropriate color and normally a charge-controlling compound giving triboelectric charge to the toner, and (ii) carrier particles charging the toner particles by frictional contact therewith. The carrier particles may be made of a magnetizable material, such as iron or iron oxide. In a typical construction of a developer station, the developer drum 33 contains magnets carried within a rotating sleeve causing the mixture of toner and magnetizable material to rotate therewith, to contact the surface 26 of the drum 24 in a brush-like manner. Negatively charged toner particles, triboelectrically charged to a level of, for example 9 mu C/g, are attracted to the photo-exposed areas on the drum surface 26 by the electric field between these areas and the negatively electrically biased developer so that the latent image becomes visible. After development, the toner image adhering to the drum surface 26 is transferred to the moving web 12 by a transfer corona device 34. The moving web 12 is in face-to-face contact with the drum surface 26 over a wrapping angle omega (ω) of about 15 degrees determined by the position of the opposing drum surface 26'. The charge sprayed by the transfer corona device, being on the opposite side of the web to the drum, and having a polarity opposite in sign to that of the charge on the toner particles, attracts the toner particles away from the drum surface 26 and onto the surface of the web 12. The transfer corona device 34 typically has its corona wire positioned about 7 mm from the housing which surrounds it and 7 mm from the paper web. A typical transfer corona current is about 3 mA/cm web width. The transfer corona device 34 also serves to generate a strong adherent force between the web 12 and the drum surface 26, causing the latter to be rotated in synchronism with the movement of the web 12 and urging the toner particles into firm contact with the surface of the web 12. The web, however, should not tend to wrap around the drum beyond the point dictated by the positioning of the opposed drum 24' and there is therefore provided circumferentially beyond the transfer corona device 34 a web discharge corona device 38 driven by alternating current and serving to discharge the web 12 and thereby allow the web to become released from the drum surface 26. The web discharge corona device 38 also serves to eliminate sparking as the web leaves the surface 26 of the drum.

Thereafter, the drum surface 26 is pre-charged to a level of, for example −580V, by a pre-charging corotron or scorotron device 40. The pre-charging makes the final charging by the corona 28 easier. Thereby, any residual toner which might still cling to the drum surface may be more easily removed by a cleaning unit 42 known in the art. Final traces of the preceding electrostatic image are erased by the corona 28. The cleaning unit 42 includes an adjustably mounted cleaning brush 43, the position of which can be adjusted towards or away from the drum surface 26 to ensure optimum cleaning. The cleaning brush 43 is grounded or subject to such a potential with respect to the drum as to attract the residual toner particles away from the drum surface. After cleaning, the drum surface is ready for another recording cycle. After passing the first printing station A, as described above, the web passes successively to printing stations B, C and D, where images in other colors are transferred to the web. For duplex printing, images are formed at stations A', B', C' and D' with the A' image formed subsequent to the A image and following for each successive print station. It is critical that the images produced in successive stations be in registration with each other. In order to achieve this, the start of the imaging process at each station has to be critically timed.

However, as is also conceded in said U.S. Pat. No. 5,455,668, etc., accurate registration of the images is possible only if there is no slip between the web 12 and the drum surface 26. At slower printing speeds, the electrostatic adherent force between the web and the drum generated by the transfer corona device 34, the wrapping angle omega ($\omega$) determined by the relative position of the opposed drums 24 and 24', and the tension in the web generated by the drive roller 22 and/or the braking effect of the brake are such as to ensure that the peripheral speed of the drum 24 is determined substantially only by the movement of the web 12, thereby ensuring that the drum surface moves synchronously with the web. To this end in said U.S. Pat. No. 5,455,668 etc. systems, it is taught that the rotatable cleaning brush 43 is driven to rotate in a sense the same as to that of the drum 24 and at a peripheral speed of, for example twice the peripheral speed of the drum surface. The developing unit 32 includes a brush-like developer drum 33 which rotates in a sense opposite to that of the drum 24. The resultant torque applied to the drum 24 by the rotating developing brush 33 and the counter-rotating cleaning brush 43 is adjusted to be close to zero, thereby ensuring that the only torque applied to the drum is derived from the adherent force between the drum 24 and the web 12. Adjustment of this resultant force is possible by virtue of the adjustable mounting of the cleaning brush 43 and/or the developing brush 33 and the brush characteristics.

However, not only are the above adjustments variable and problematic, as the attempted printing speed becomes higher, there is an even greater likelihood that there will be slippage between the web and the surface of the photoreceptive drum, or excess drag on the web, causing it to tear. The system disclosed herein avoids such criticality or slippage by estimating or measuring the rotational drag force on the web imparted by the photoreceptor drums, including the torque drags thereon from the cleaning and imaging systems, and then provides a partial drive mechanism for each drum so as to eliminate most of, but not all of, the drag force imparted to the web. In this manner, the web can still drive all the photoreceptors without stretching, slipping, or tearing. Thus the timing or common element single image registration aspect of the web drive will not be lost.

Figure 3:
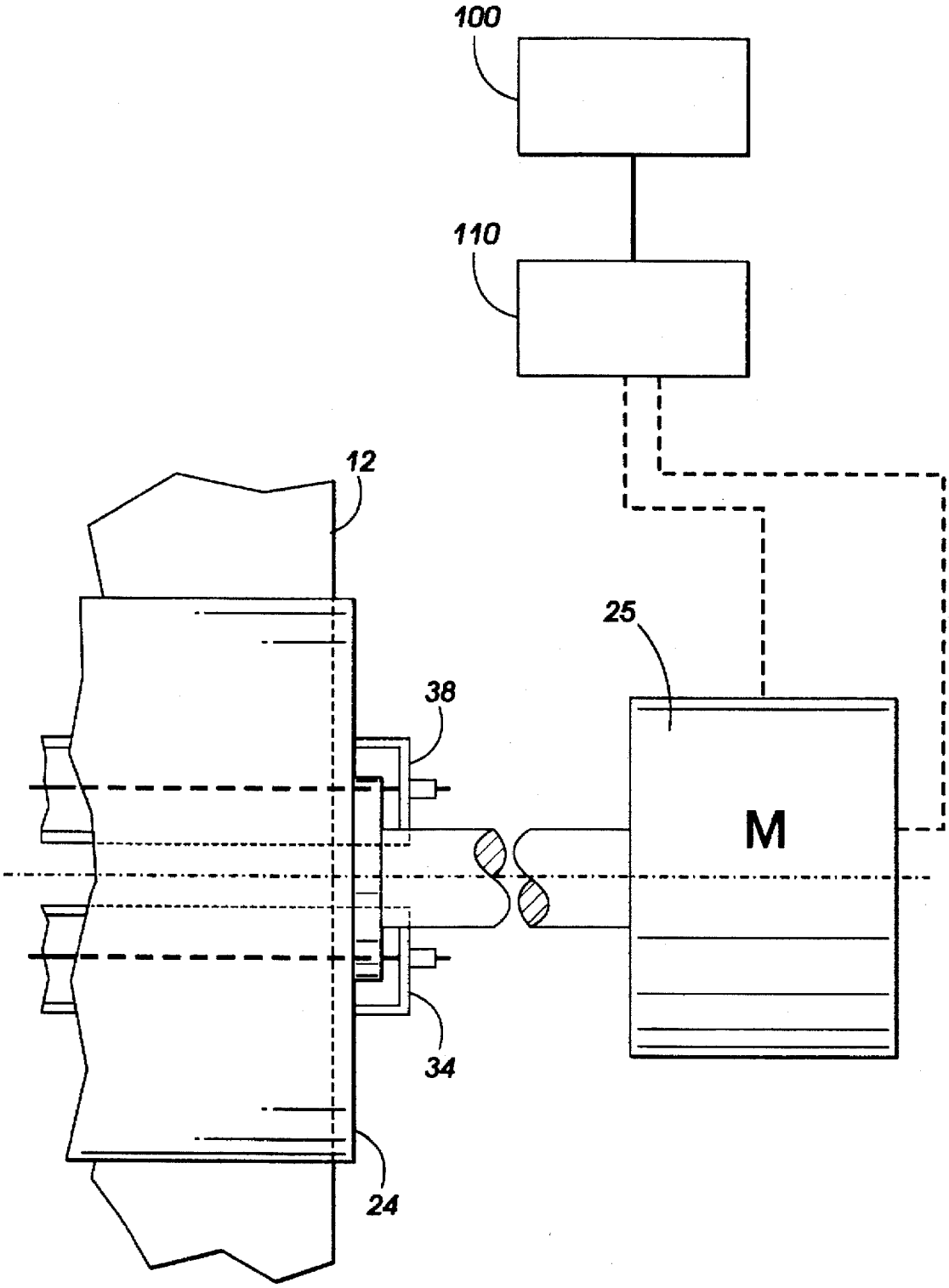
FIG. 3 illustrates schematically in a partial view taken along the line 3—3 in FIG. 2 one of the drives for one of the photoreceptors.

For example, as a first step one can directly or indirectly measure the rotational drag force in foot-pounds or KG/meters of torque of the PR drum, from a torque needed to drive it. That will include drag from windage, bearing friction, and, especially, the friction of all the standard xerographic station components engaging the PR surface in operation as the PR drum rotates at the desired web velocity. This is approximately equal to the web pulling force (pull from the electrostatic tacking of the web in the transfer area). Once this drag torque is measured, there is provided, as shown, a torque less than that amount, insufficient to rotate that PR drum, but enough torque to compensate for the majority of said drag. This can be accomplished by a small simple connecting independent D.C. motor "M" drive for each PR drum, current limited 110 so as to only have only sufficient motor torque output to overcome only a substantial portion of the frictions and other resistances to rotation of the drum, so that the electrostatically tacked web itself still controls the speed of the drum, yet the drum no longer imparts a large drag resistance on the web, (which could tear the web or cause the web to slip on the drum). Current limiter 110 operates with controller 100 using a feedback loop as shown in FIG. 3 to monitor the current draw by the motor so as to maintain the proper torque application to the PR drum. As noted, that could be called an "underdrive", or these motors M could be referred to as "overdriven" by the web drive. Note that no variable speeds, servo drives, feedback sensors or feedback systems are required. Note also that with this system, it is not necessary to use a forward overdriven cleaning system (the torque effect of which would vary with wear and toner contamination anyway).

Even if the motor "M" supplies a torque somewhat greater than the PR drag, the transfer tacking adhesion of the web to the PR will still control the PR speed.

On startups or restarts of the printer, the PR drums or belts can be briefly initially driven with a much higher torque (by briefly applying to each motor M a much higher voltage and/or current than that described above for overcoming the PR back resistance from the process speed torque), to help thread the paper web through the system and during the time the PR drums, etc. are being brought up to process speed. Otherwise that would have to be done by an even higher pulling force on the web during startup.

As alternative embodiments, there could be used a simple, noncritical, magnetic, hydraulic or other fluid slippage drive running at more than the process speed but with slippage, having a torque that is less than the total PR drag, to overcome a substantial portion, but not all, of the PR drag, so as to likewise allow the web drive of the drums at higher speeds.

In recapitulation, there is disclosed in this embodiment a simple auxiliary or partial drive for a photoreceptor unit in a web velocity controlled multi station printing system. Each photoreceptor unit in this multi station printing system has a torque limited drive unit which provides rotational torque to overcome most of, but not all, of the rotational drag forces on the photoreceptor. In this manner, the web contact with the photoreceptor can control the speed of the photoreceptor by overrunning the torque provided by the partial drive yet minimize the possibility of slippage or tearing of the web.

While this invention has been described in conjunction with a specific embodiment thereof, many alternatives, modifications, and variations will be apparent to those skilled in the art. Accordingly, it is intended to embrace all such alternatives, modifications and variations that fall within the spirit and broad scope of the appended claims.

I claim:

1. An electrographic multiple station printer for printing an image on a print web, which comprises:

a plurality of toner image-producing electrostatographic stations each having rotatable endless surface means onto which a toner image can be formed;

means for conveying the web in succession past said stations;

means for controlling the speed and tension of the web while it is running past said stations;

a drive unit for each of said plurality of toner image-producing electrographic stations, wherein each of said drive units for each of said plurality of toner image-producing electrostatographic stations are torque limited so as to provide substantially only enough rotational torque to overcome drag forces on the rotatable endless surface means; and transfer means for transferring the toner image on each rotatable surface means onto the web, wherein in said printer adherent contact of said web with said rotatable endless surface means is such that the movement of said web controls the peripheral speed of said rotatable endless surface means in synchronism with the movement of said web.

2. A printer according to claim 1, wherein said transfer means is a corona discharge device providing electrostatic adhesion between the web and the endless surface means.

3. A printer according to claim 1, wherein the web is a final support for the toner images and is unwound from a roll, image-fixing means being provided for fixing the transferred toner images on the web.

4. A printer according to claim 3, which further comprises a supply station comprising a roll stand for unwinding a roll of web to be printed in the printer, and a web cutter for cutting the printed web into sheets.

5. In a reproduction system in which flimsy paper or other such print substrate is fed as a continuous and moving web past a rotating imaging system having a photoconductive imaging surface, from which surface print images are transferred to said web print substrate while a minor portion of said web print substrate is in contact with a portion of said photoconductive imaging surface of said rotating imaging system, and wherein said rotating imaging system is designed to be rotated by said engagement and movement of said web print substrate by said web print substrate being pulled by a web pulling force at a substantially constant velocity from downstream of said rotating imaging system surface, so as to attempt to provide continuous non-slip synchronous movement of said web print substrate and said imaging system photoconductive imaging surface while they are in said contact, and wherein said rotating imaging system has a resistance to said rotation by said web print substrate, the improvement comprising:

applying an independent rotational force to said rotating imaging system which is not substantially more than said resistance to rotation of said rotating imaging system, so as not be able to rotate said rotating imaging system faster than said web print substrate velocity, yet which independent rotational force is sufficient to substantially reduce said downstream web pulling force on said web print substrate needed to rotate said rotating imaging system limited torque electric motor.

6. The reproduction system of claim 5, wherein there are a plurality of said rotating imaging systems sequentially rotated by the same said moving web print substrate, and said independent rotational force is independently applied to each said rotating imaging system.

7. The reproduction system of claim 6, wherein said independent rotational force is applied to said rotating imaging system by a connecting limited torque electric motor.

8. The reproduction system of claim 5, wherein said independent rotational force is applied to said rotating imaging system by a connecting limited torque electric motor.

9. In a reproduction system in which flimsy paper or other such print substrate is fed as a continuous and moving web past a rotating imaging system surface, from which surface print images are transferred to said web print substrate while a minor portion of said web is in contact with a portion of said surface of said rotating imaging system, and wherein said rotating imaging system is designed to be rotated by said engagement and movement of said moving image substrate web by said web, by said web being pulled by a web pulling force at a substantially constant velocity from downstream of said rotating imaging system, so as to attempt to provide continuous non-slip synchronous movement of said print substrate web and said imaging system surface while they are in said contact, and wherein said rotating imaging system has a resistance to said rotation by said web, the improvement comprising:

applying an independent rotational force to said rotating imaging system which is not substantially more than said resistance to rotation of said rotating imaging system, so as not be able to rotate said rotating imaging system faster than said web velocity, yet which independent rotational force is sufficient to substantially reduce said downstream web pulling force on said web needed to rotate said rotating imaging system wherein said independent rotational force is briefly substantially increased during the startup of said rotating imaging system.

* * * * *